US007947604B2

(12) United States Patent
Zhang et al.

(10) Patent No.: US 7,947,604 B2
(45) Date of Patent: May 24, 2011

(54) METHOD FOR CORROSION PREVENTION DURING PLANARIZATION

(75) Inventors: Fan Zhang, Singapore (SG); Lup San Leong, Singapore (SG); Yong Kong Siew, Sungai Pelek (MY); Bei Chao Zhang, Singapore (SG)

(73) Assignee: Chartered Semiconductor Manufacturing, Ltd., Singapore (SG)

( * ) Notice: Subject to any disclaimer, the term of this patent is extended or adjusted under 35 U.S.C. 154(b) by 534 days.

(21) Appl. No.: 12/019,647

(22) Filed: Jan. 25, 2008

(65) Prior Publication Data

US 2009/0191792 A1 Jul. 30, 2009

(51) Int. Cl.
*H01L 21/302* (2006.01)

(52) U.S. Cl. ..... 438/692; 438/700; 216/88; 216/89

(58) Field of Classification Search ..... 438/692, 438/700; 216/88, 89
See application file for complete search history.

(56) References Cited

U.S. PATENT DOCUMENTS

| | | | | |
|---|---|---|---|---|
| 6,057,245 | A | 5/2000 | Annapragada et al. | |
| 6,328,871 | B1 * | 12/2001 | Ding et al. | 205/183 |
| 6,579,154 | B2 | 6/2003 | Yamamoto et al. | |
| 6,833,109 | B1 | 12/2004 | Aoki et al. | |
| 7,300,684 | B2 * | 11/2007 | Boardman et al. | 427/249.7 |
| 2004/0132381 | A1 | 7/2004 | Basol et al. | |
| 2004/0182721 | A1 | 9/2004 | Manens et al. | |
| 2004/0219298 | A1 | 11/2004 | Fukunaga et al. | |
| 2004/0231597 | A1 | 11/2004 | Dong et al. | |
| 2005/0056537 | A1 | 3/2005 | Chen et al. | |
| 2005/0202677 | A1 * | 9/2005 | Hsu et al. | 438/692 |

OTHER PUBLICATIONS

J.-Huang et al. Mateerials chemistry and Physics, vol. 77, (2002) 14-21.*

* cited by examiner

*Primary Examiner* — Nadine G Norton
*Assistant Examiner* — Maki A Angadi
(74) *Attorney, Agent, or Firm* — Horizon IP Pte Ltd

(57) ABSTRACT

The present invention relates to the reduction or complete prevention of Cu corrosion during a planarization or polishing process. In one aspect of the invention, RF signal is used to establish a negative bias in front of the wafer surface following polishing to eliminate $Cu^{+}$ or $Cu^{2+}$ migrations. In another aspect of the invention, a DC Voltage power supply is used to establish the negative bias.

21 Claims, 6 Drawing Sheets

METHOD FOR CORROSION PREVENTION DURING PLANARIZATION

FIELD OF THE INVENTION

The present invention relates generally to integrated circuits (ICs), and more particularly to planarizing substrate surfaces in the manufacturing of ICs.

BACKGROUND OF THE INVENTION

The fabrication of ICs involves the formation of features on a substrate that make up circuit components, such as transistors, resistors and capacitors. The devices are interconnected, enabling the ICs to perform the desired functions. An important aspect of the manufacturing of ICs is the need to provide planar surfaces using planarization techniques.

One technique used to planarize substrates is chemical mechanical polishing (CMP). CMP tools generally include a platen with a polishing pad and a chuck for holding a wafer in place. During polishing, the wafer surface to be planarized is pressed against the rotating polishing pad by the chuck. Slurry which includes small abrasive particles is provided between the wafer surface and the pad. The wafer may also be rotated and oscillated over the surface of the polishing pad.

Another technique for planarizing substrates is electrochemical mechanical polishing (eCMP). Typically eCMP is used to polish metal layers. In eCMP, an electrical potential is applied to the wafer with an electrolytic planarizing liquid. Electropolishing is conducted under low pressure.

However, we have observed that in conventional planarizing processes for copper (Cu) interconnects, metal corrosion occurs. Such corrosion can be detrimental to reliability.

It is therefore desirable to reduce Cu corrosion resulting from polishing or planarization.

SUMMARY OF THE INVENTION

The present invention relates generally to ICs. In particular, the present invention relates to the reduction or complete prevention of Cu corrosion during the planarization or polishing process. In one aspect, the invention relates to a method of forming an IC. A wafer with a first surface is provided. The first surface of the wafer is polished with a polishing surface and slurry. A negative bias is applied to the first surface to reduce corrosion. The negative bias, in one embodiment, is generated by an RF signal. The negative bias is applied with the polished wafer surface while still in contact with a liquid polishing solution.

In another aspect, the invention relates to a polishing system. The polishing system includes a carrier for holding a wafer to be polished and a rotatable platen having a polishing surface for polishing a surface of the wafer. A negative bias generator or negative bias means is provided in the system for generating a negative bias when activated on the surface of the wafer when held by the carrier to reduce corrosion.

These and other objects, along with advantages and features of the present invention herein disclosed, will become apparent through reference to the following description and the accompanying drawings. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. Various embodiments of the present invention are described with reference to the following drawings, in which.

DETAILED DESCRIPTION OF THE INVENTION

The present invention relates to integrated circuits. In particular, the present invention relates to polishing of a wafer surface to provide a planar surface. In one embodiment, the invention relates to polishing of conductive materials. The invention is particularly useful for polishing materials where electro-corrosion can occur.

Figure 1:
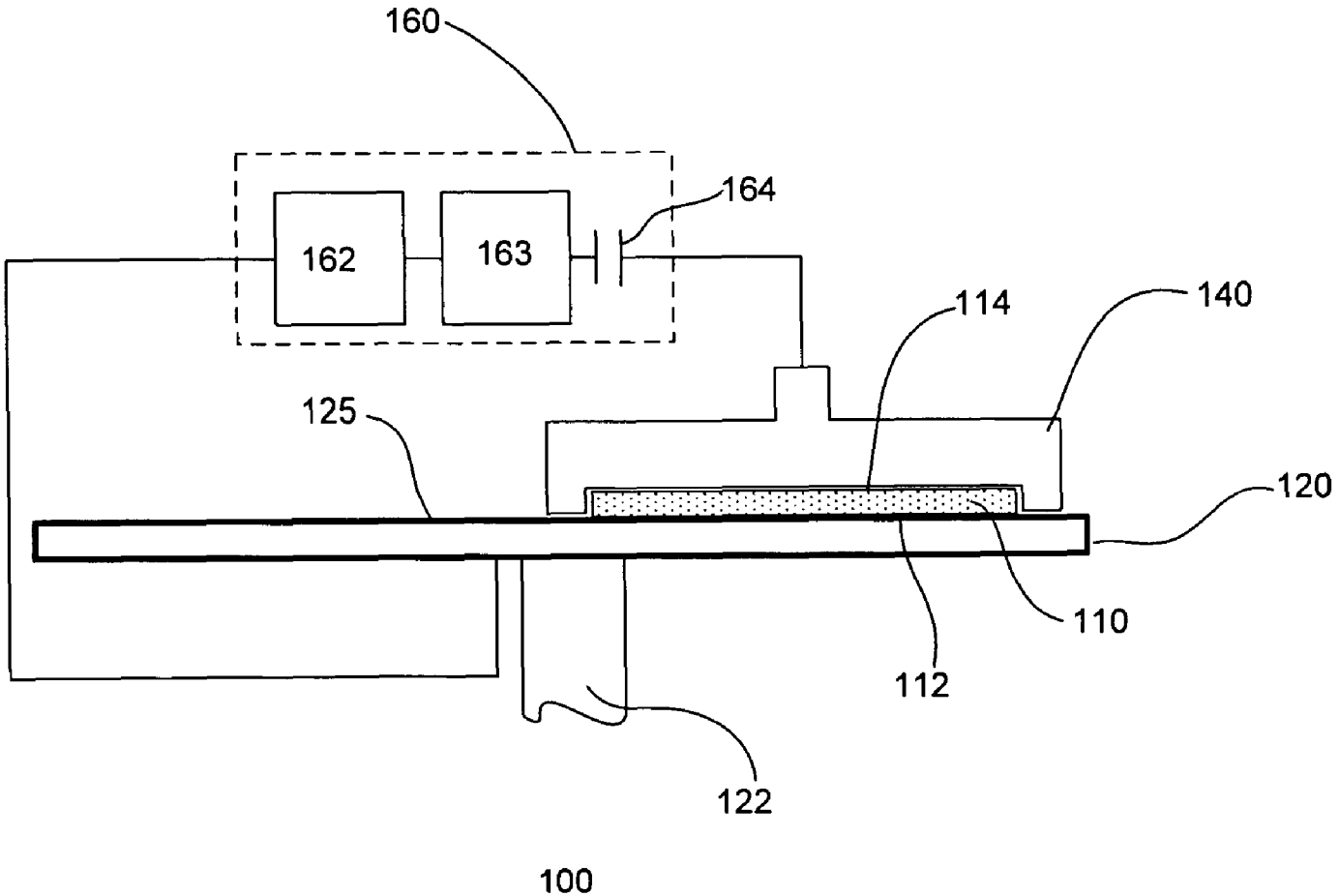
FIG. 1 shows a polishing system in accordance with one embodiment of the invention.

FIG. 1 shows a polishing system 100 in accordance with one embodiment of the invention. The polishing system comprises a CMP system. Other types of polishing system, such as eCMP, are also useful. Typically, the CMP system includes a wafer carrier 140. The wafer carrier, for example, includes a cavity 114 for accommodating a wafer 110. A chuck fixes the wafer in place. A control arm (not shown) is provided to which the wafer carrier is attached. The control arm moves the wafer carrier into a desired position, for example, wafer mounting or polishing. During polishing, the wafer carrier is rotated which rotates the wafer.

The CMP system also includes a platen 120. The platen can be circular in shape. Other shapes are also useful. Typically, the platen includes a polishing pad 125 attached thereto. The pad provides a polishing surface for the wafer. For example, the polishing pad can comprise a textured surface formed from polyurethane. Other types of polishing pads are also useful. The platen includes a shaft 122 mounted to a base (not shown). The base rotates the platen during polishing. As shown, the wafer carrier is positioned above the platen in a horizontal arrangement. Other arrangements of the platen and wafer carrier are also useful, for example, non-horizontal position or wafer carrier below the platen.

In accordance with one embodiment of the invention, a negative bias generator 160 is provided for the polishing system. The negative bias generator (NBG) produces a negative bias on the top wafer surface to be polished. The NBG includes first and second terminals. One terminal is coupled to the wafer carrier while the other is coupled to the platen. In one embodiment, the terminal is coupled to the wafer via the carrier while the other terminal is coupled to the platen. One or more contacts can be provided at the carrier and platen. For example, 1) a single contact can be provided at the carrier to contact the wafer and a single contact can be provided at the center of the platen, 2) a plurality of contacts can be provided at the wafer carrier and platen or 3) a combination thereof. Providing a platen made of electrically conductive materials, i.e., the entire platen is conductive, is also useful.

The NBG, in one embodiment, comprises a RF bias generator to provide a RF signal to produce a negative bias on the wafer surface facing the platen. The use of RF signal is preferable since RF has the ability to establish or maintain an electric field when the conductive layer becomes discontinuous or interrupted with dielectric materials. For example, the electric field can be maintained when the conductive layer is polished to the level of the intermetal dielectric, creating exposed metal lines and intermetal dielectric separating the exposed metal lines (metal islands separated by dielectric material).

The RF bias generator comprises an RF source 162. Various types of RF sources can be used. The RF bias generator can also include an RF matching circuit 163 and a converter 164. The RF matching circuit, for example, ensures that the RF source impedance and load are matched. The load, for example, can include the equipment (such as platen, wafer holder, and wiring), processing materials (such as slurry) as well as the other components of the NGB. Typically, load matching is performed at the setup phase. However, load matching may need to be performed subsequently due to, for example, changes in the equipment as well as changes in processing, such as use of different types of slurries. Preferably, the RF matching circuit comprises a tunable RF matching circuit to accommodate possible changes in the load. The converter, for example, comprises a capacitor. The capacitor serves to stop DC voltage or current flow. Other types of NBGs are also useful. For example, the NBG can comprise a DC power supply.

We have discovered that applying a negative bias to the wafer surface to be polished reduces corrosion of metals, such as copper. The negative bias creates a negatively charged electrical field on the wafer surface, thereby causing it to act as a cathode. More electrons and/or negatively charged compounds are accumulated on the wafer surface than positively charged compounds, such as $Cu^{+}$ or $Cu^{2+}$, due to the negative charged electric field. This reduces or prevents, for example, $Cu^{+}$ or $Cu^{2+}$ formation on the wafer surface, which reduces or prevents corrosion.

Figure 2A:
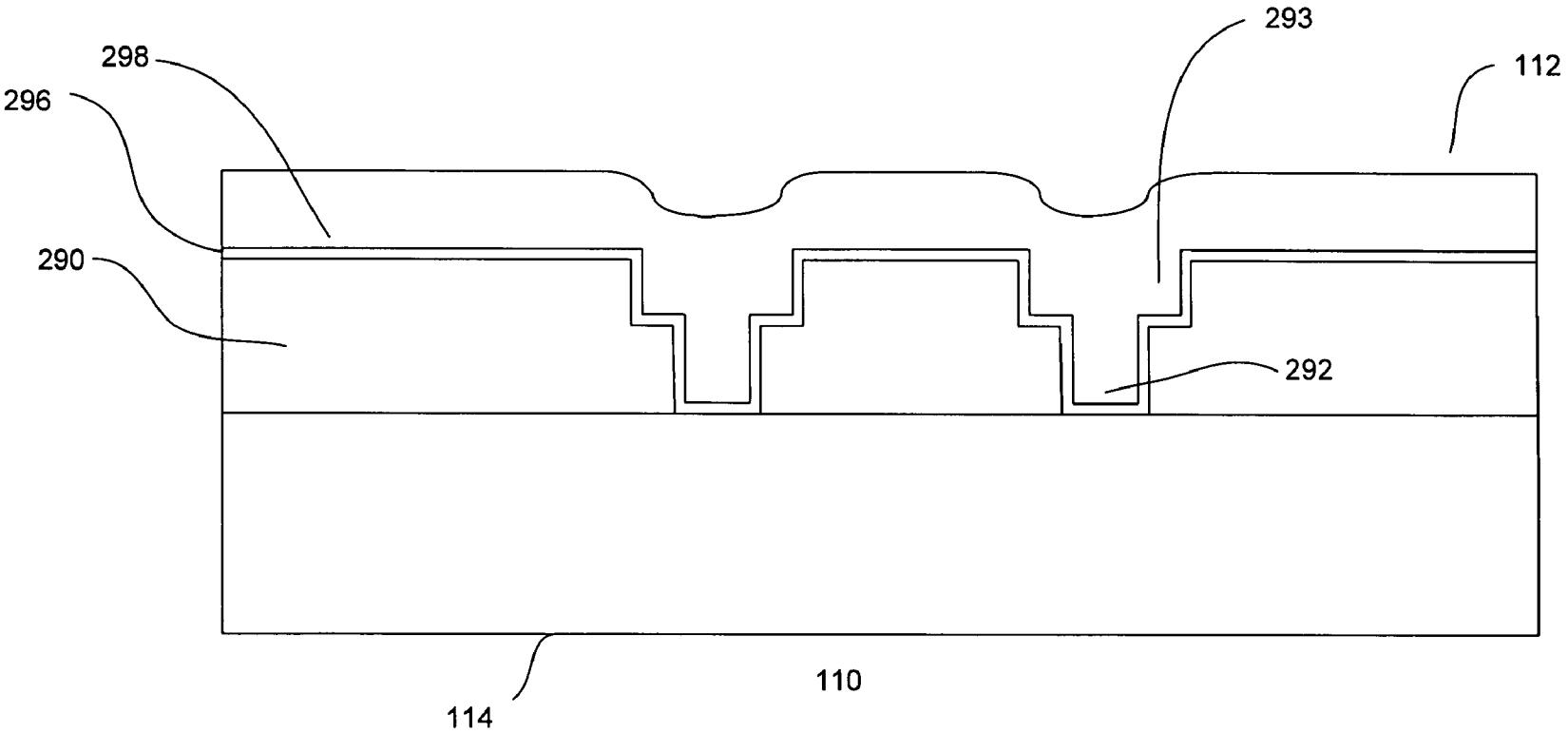
FIGS. 2*a-b* show a portion of an exemplary wafer whose top surface is polished by the polishing system.

FIG. 2*a* shows a portion of an exemplary wafer 110 whose top surface 112 is polished by the polishing system. The substrate, for example, can include various types of semiconductor substrates, such as silicon or silicon-on-insulator. Other types of substrates are also useful. The substrate can be at various stage of processing. In one embodiment, the substrate is at a metal level stage of processing. The metal stage can be any metal stage, for example, first (M1), second (M2) to the last metal stage. Other processing stages are also useful.

At the metal stage of processing, the substrate includes a dielectric layer 290 which serves as an interlevel dielectric. In one embodiment, the dielectric layer comprises low k or porous dielectric material. Other types of dielectric materials are also useful. Trench openings 293 are formed in the interlevel dielectric layer. The trenches can be formed using various conventional techniques such as single or dual damascene techniques. A conductive layer 298 is deposited on the substrate to fill the trenches. Alternatively, in dual damascene techniques, the conductive layer fills both trenches and vias 292 for desired interconnections to levels or devices below. The conductive layer, for example, comprises copper or copper alloy. Other types of conductive materials are also useful. Typically, a barrier and/or liner layer 296 is provided on the dielectric layer, lining the trenches (and vias for dual damascene applications) prior to depositing the conductive layer. The barrier layer, for example, comprises composite barrier layer of tantalum and tantalum nitride (Ta/TaN). Other types of materials are also useful and may depend on the materials of the conductive layer or application. As shown, the top surface of the conductive layer is not planar.

Figure 3:
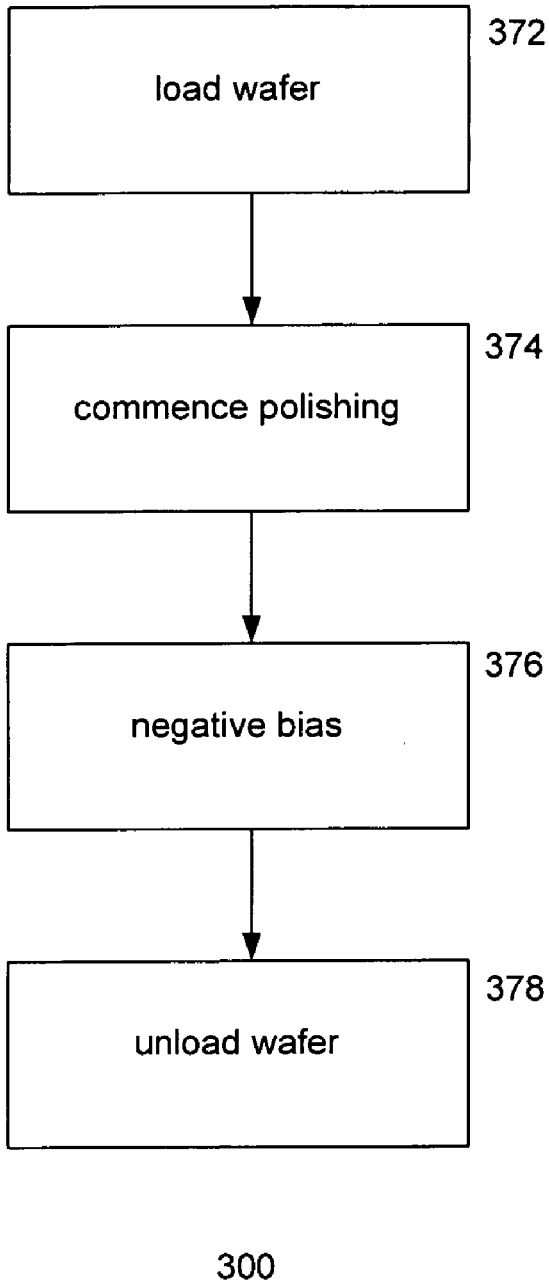
FIG. 3 shows a process flow for polishing a wafer in accordance with one embodiment of the invention.

FIG. 3 shows a process 300 for polishing a wafer in accordance with one embodiment of the invention. The wafer, for example, is at the metal stage of processing. To polish the top surface of the wafer, the back surface of the wafer is attached to the wafer carrier at step 372. Typically a chuck is used to mount the wafer to the wafer carrier. The wafer carrier is moved into position on top of the platen, pressing the wafer against the polishing pad.

Polishing of the wafer commences at step 374. During polishing, the disk (carrier) and platen are rotated. Typically, the carrier and platen are rotated in the same direction. A slurry is dispensed onto the platen, dispersing it between pad and wafer surface to be polished. Various types of slurry can be used and depends on, for example, materials and process application. The CMP process can employ various process parameters to achieve removal of the desired materials on the surface of the substrate.

Figure 2B:
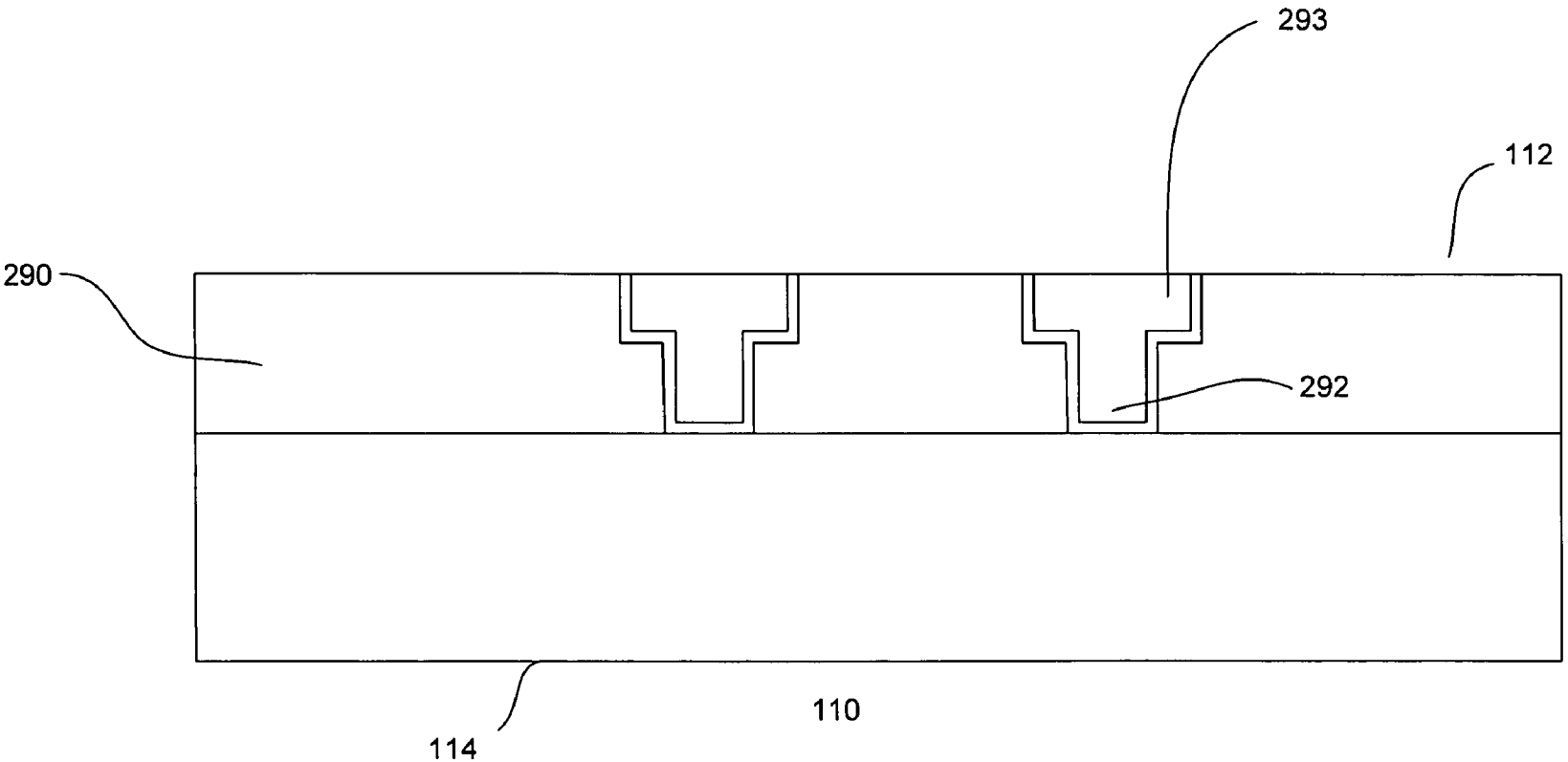

After a desired amount of material is removed from the surface of the wafer, polishing is completed. For example, excess conductive material over the dielectric layer is removed, leaving a planar top surface 112, as shown in FIG. 2*b*. Thereafter, the platen and carrier cease rotating.

Referring back to FIG. 3, in one embodiment of the invention, a negative bias is applied to the top substrate surface at step 376 while the wafer remains in contact with the slurry. Preferably, the negative bias is constant. This reduces side effects. Providing a negative bias during polishing can also be useful to prevent corrosion.

In one embodiment, an RF signal is employed to provide a negative bias to the surface of the wafer. The negative bias is sufficient to reduce corrosion. The RF signal is generated by the RF generator. In one embodiment, the RF signal is about 50 W to 1000 W having a frequency between 2 MHz and 200 MHz. RF biasing is advantageously self-biasing. For example, the voltage and current are automatically adjusted depending on the amount of floated charges in the polishing solution/slurry and the RF power applied. Thereafter, the wafer is demounted from the wafer carrier at step 378. Processing of the wafer continues, forming the IC.

Figure 4:
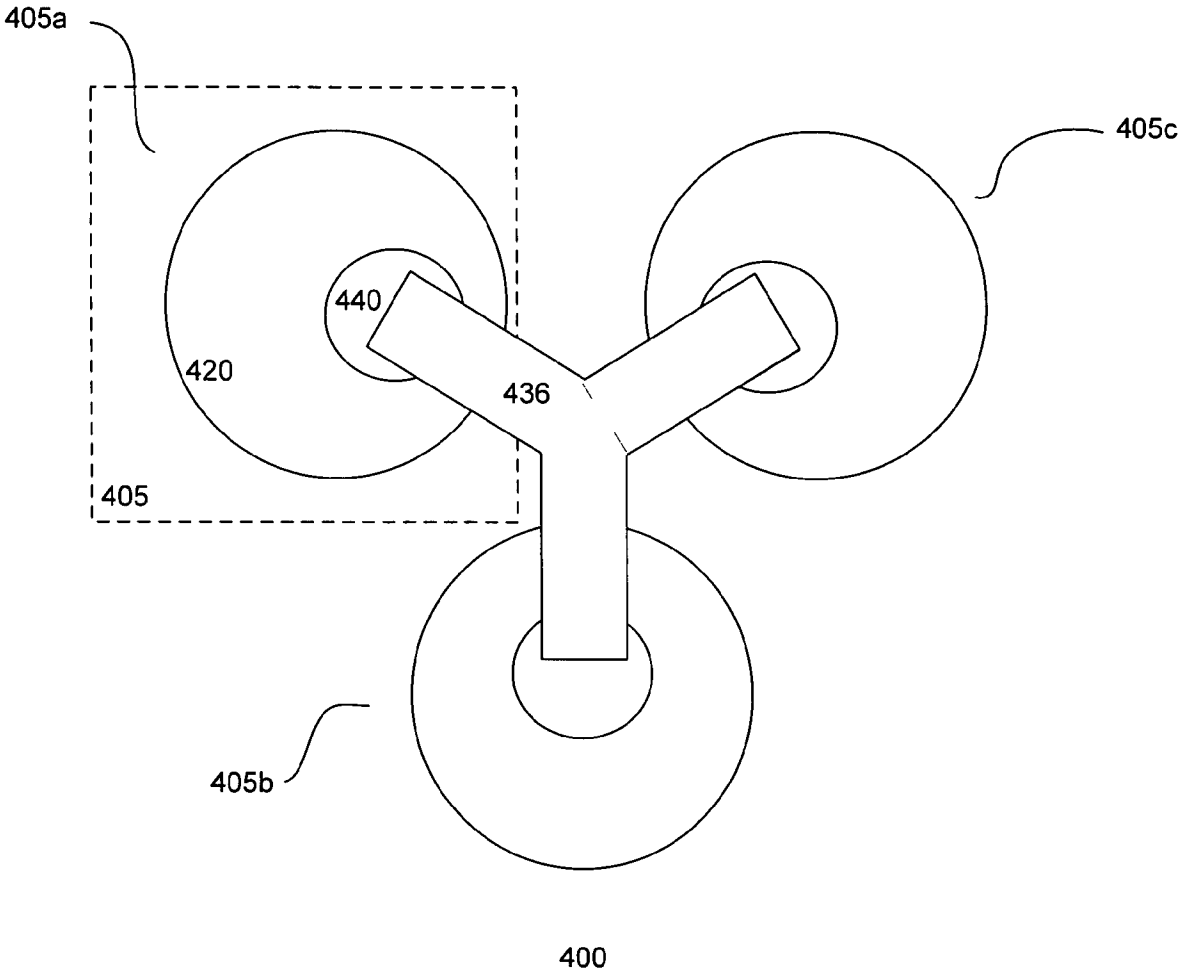
FIG. 4 shows a polishing system in accordance with another embodiment of the invention.

FIG. 4 shows a polishing system 400 in accordance with another embodiment of the invention. The polishing system, for example, comprises an electro-chemical mechanical polishing (eCMP) system. Other types of polishing systems, such as CMP systems, are also useful. The eCMP system can be a Relexion LK eCMP system from Applied Materials, Inc., Santa Clara, Calif. The polishing system can also be a CMP system. Other types of polishing systems are also useful. ECMP systems use low down force to remove materials from the wafer surface, which is particularly useful for fragile dielectric applications, such as low k or porous dielectric materials. Typically, the down force used in eCMP systems is less than about 2 psi. Preferably, the down force is less than 1 psi.

In one embodiment, the eCMP system comprises a station 405. The station includes a platen 420 with a polishing pad thereon. The platen, similar to that of FIG. 1, is mounted to a base via a shaft, which is rotated during polishing. A wafer carrier 440 is provided. The wafer carrier is mounted to a control arm 436. The control arm moves the wafer carrier into the desired position, such as polishing or mounting or demounting of the wafer. The platen is disposed in a basin (not shown) which contains conductive electrolytic slurry or liquid being used in eCMP. For example, the electrolytic slurry can electrochemically remove conductive materials such as copper, tantalum, or tantalum nitride. An electrode is disposed in the basin and contacts the electrolytic slurry when filled. The electrode, for example, is disposed on the bottom of the basin. The electrode provides a charge to the slurry, activating it to electrochemically remove material from the surface of the substrate.

In accordance with one embodiment of the invention, an NBG as described in FIG. 1 is provided for the station of the polishing system to produce a negative bias on the top wafer surface to be polished.

In one embodiment, the polishing system, such as an eCMP system, comprises a plurality of stations. As shown, the system comprises first, second and third stations 405*a-c*. As shown, the control arm comprises a carousel which can rotate and move the wafer to the different stations during the polishing process. Different stations are provided for different sub-processes in the polishing process. For example, the polishing process comprises three separate sequential sub-processes. The first sub-process removes the excess conductive material on the wafer, the second sub-process removes the liner layer over the surface of the substrate, while the third sub-process removes dielectric, liner and conductive material to produce a planar top surface. Preferably, the NBG is provided for the third station. Providing NBGs at one, both or other combinations of stations is also useful.

Typically, in multi-station processing, a first wafer is loaded to the wafer carrier and transferred to the first station for processing. After processing at the first station is completed, it is transferred to the second station. A second wafer is then loaded into the wafer carrier at the first station. Both the first and second wafers are processed at their respective stations. After processing is completed on both first and second wafers, they are transferred to the next station for processing while a third wafer is loaded at the wafer carrier at the first station. Processing on all three wafers is performed simultaneously. After processing is completed on the wafers, the carousel moves the second and third wafers to the third and second stations. The first wafer is unloaded from the carrier and another wafer is loaded and ready for processing at the first station. The ability to perform processing on a plurality of wafers increases throughput.

The processing time at the different stations may be different. Typically, processing time is the longest at the first station and shortest at the third station, with the second station having a processing time between the first and third stations. For example, when polishing is finished on the wafer at the third station, it is maintained in the electrolytic slurry until processing of the other wafers at the other stations is completed. In accordance with one embodiment of the invention, a negative bias is provided at the top wafer surface while it is maintained in the solution after polishing process at the station has been completed.

As described, the multi-station polishing system comprises three wafer carriers and three platens. Alternatively, the polishing system can include other numbers of carriers. For example, the polishing system can include four wafer carriers for three platens.

Figure 5:
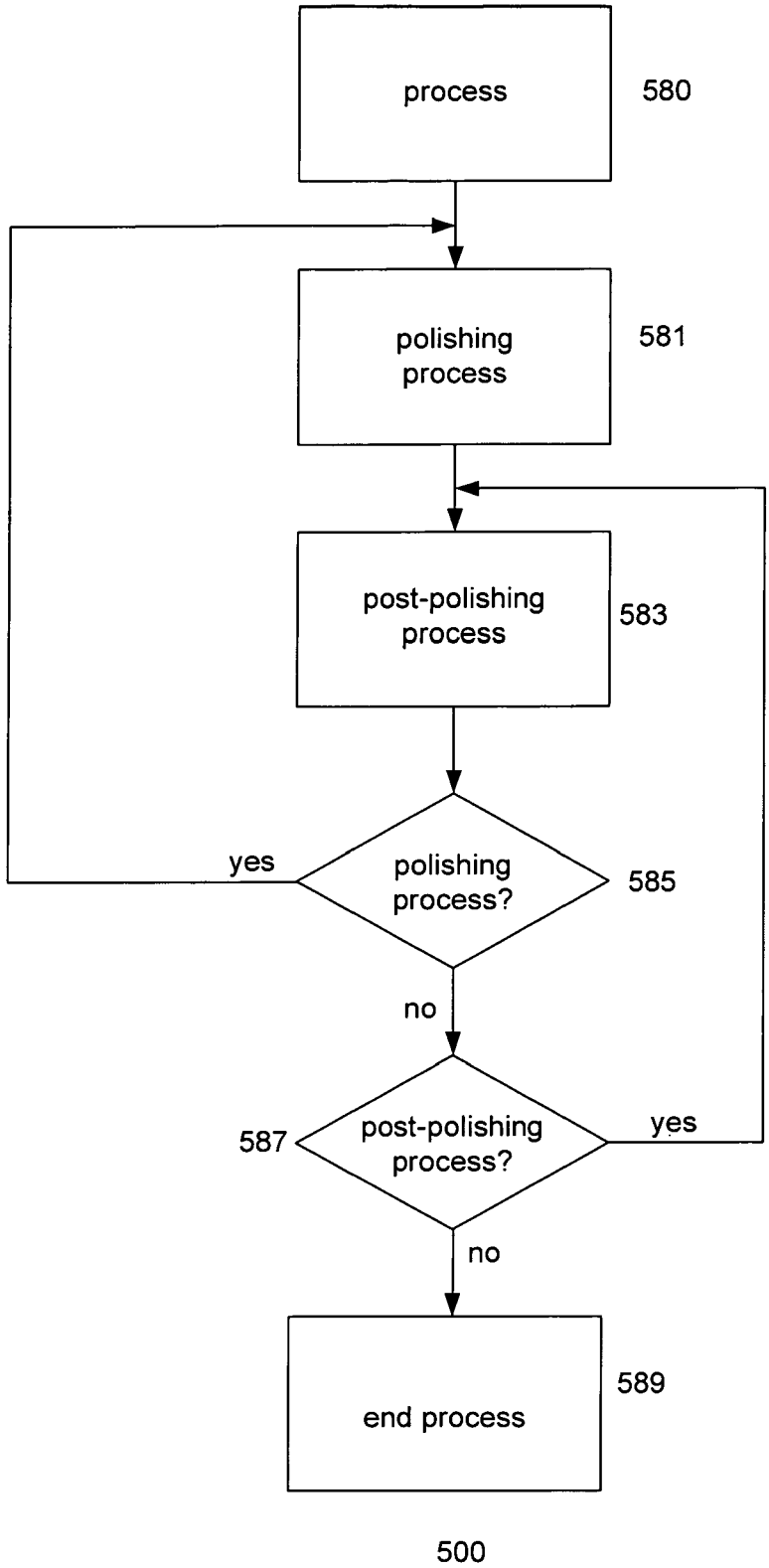
FIG. 5 shows a process flow for forming ICs in accordance with one embodiment of the invention.

FIG. 5 shows a process flow 500 for forming ICs in accordance with one embodiment of the invention. To form ICs, numerous processes are performed. In one embodiment, the wafer is processed after deposition of the conductive layer of the first metal level (M1) at step 580. Providing a wafer at other processing stages is also useful. At step 581, the wafer is polished in accordance with one embodiment of the invention to provide a planar surface. For example, a negative bias is provided at the surface of the wafer to be polished. After polishing, processing of the wafer continues at step 583. For example, additional metal levels can be formed. Step 585 determines if a polishing process is required. If so, the process flow returns to 581. Otherwise, the process flow continues to step 587 to determine if further processing is required. If not, the process flow ends at step 589.

The above invention may be embodied in other specific forms without departing from the spirit or essential characteristics thereof. The foregoing embodiments, therefore, are to be considered in all respects illustrative rather than limiting the invention described herein. The scope of the invention is thus indicated by the appended claims, rather than by the foregoing description, and all changes that come within the meaning and range of equivalency of the claims are intended to be embraced therein.

What is claimed is:

1. A method of fabricating integrated circuits comprising:
providing a wafer with a first surface;
polishing the first surface of the wafer with a polishing surface and slurry; and
applying a negative bias on the first surface, wherein the negative bias reduces corrosion caused by the slurry.

2. The method of claim 1 wherein polishing the wafer comprises electro-chemical mechanical polishing or chemical mechanical polishing.

3. The method of claim 2 wherein applying the negative bias comprises applying the negative bias when polishing has stopped and while the wafer is in contact with the slurry.

4. The method of claim 3 wherein the first surface comprises conductive material including metal or alloy.

5. The method of claim 3 wherein the first surface comprises copper, copper alloy, or tungsten.

6. The method of claim 1 wherein applying the negative bias comprises applying the negative bias when polishing has stopped and while the wafer is in contact with the slurry.

7. The method of claim 6 wherein the first surface comprises conductive material including metal or alloy.

8. The method of claim 6 wherein the first surface comprises copper, copper alloy, or tungsten.

9. The method of claim 1 wherein corrosion is caused by the slurry being in contact with the first surface.

10. The method of claim 1 wherein applying the negative bias comprises an RF signal.

11. The method of claim 10 wherein the RF signal is between about 50 and 1000 watts and at a frequency between about 2 MHz and 200 MHz.

12. The method of claim 1 wherein applying the negative bias comprises a DC signal.

13. A method of polishing a wafer comprising:
polishing a surface of the wafer with a polishing surface and slurry; and
applying a negative bias to the surface, wherein the negative bias reduces corrosion caused by the slurry.

14. The method of claim 13 wherein polishing the surface of the wafer comprises electro-chemical mechanical polishing or chemical mechanical polishing.

15. The method of claim 13 wherein the bias applying comprises applying the negative bias after the surface polishing.

16. The method of claim 15 wherein the bias applying comprises applying the negative bias with the surface in contact with the slurry.

17. The method of claim 13 wherein the negative bias is constant.

18. The method of claim 13 wherein the wafer surface comprises a conductive material selected from the group consisting of copper, copper alloy, and tungsten.

19. A method of planarizing a surface comprising:
introducing a slurry;
contacting the surface with the slurry;
contacting the surface with a polishing surface;
applying a force on the surface; and while contacting the surface with the slurry, applying a negative bias to the surface to reduce corrosion caused by the slurry.

20. The method of claim 19 wherein the force is a low down force suitable to remove materials from the surface.

21. The method of claim 19 wherein applying the negative bias comprises applying the negative bias when the force is not applied and while the surface is in contact with the slurry.

* * * * *